US008569605B2

(12) United States Patent
Grace

(10) Patent No.: US 8,569,605 B2
(45) Date of Patent: Oct. 29, 2013

(54) MUSICAL WIND INSTRUMENT WITH ELECTRONIC TUNING

(76) Inventor: Charles Henry Grace, Lakewood, OH (US)

( * ) Notice: Subject to any disclaimer, the term of this patent is extended or adjusted under 35 U.S.C. 154(b) by 0 days.

(21) Appl. No.: 13/573,049

(22) Filed: Aug. 17, 2012

(65) Prior Publication Data

US 2013/0014631 A1 Jan. 17, 2013

(51) Int. Cl.
*G10G 7/02* (2006.01)

(52) U.S. Cl.
USPC ..... 84/454

(58) Field of Classification Search
USPC ..... 84/454, 384
See application file for complete search history.

(56) References Cited

U.S. PATENT DOCUMENTS

| | | | | |
|---|---|---|---|---|
| 4,429,609 | A | 2/1984 | Warrender | |
| 5,668,340 | A * | 9/1997 | Hashizume et al. | 84/742 |
| 5,808,218 | A * | 9/1998 | Grace | 84/456 |
| 7,851,686 | B1 * | 12/2010 | Davidson | 84/454 |

* cited by examiner

*Primary Examiner* — Jianchun Qin

(57) ABSTRACT

Instrument having automatic fine-tuning of pitch with no moving parts. A flute is described as one embodiment. In flutes of the prior art the various notes are often slightly off pitch because of compromises in the locations of the holes, and musicians must compensate. In this invention a built-in electronic sensor picks up sound as a musician plays, and a circuit identifies the intended note. The played note is compared with, an accurate reference pitch and the frequency difference is used to generate a signal in phase quadrature with the played note. The quadrature signal is added to correct the pitch. The added vibration energizes a tuning actuator that is located in place of a conventional tuning plug of the flute. The tuning actuator pulls the pitch automatically to achieve a precisely correct pitch as each note is played. Also, a player can intentionally deflect the pitch.

14 Claims, 4 Drawing Sheets

MUSICAL WIND INSTRUMENT WITH ELECTRONIC TUNING

CROSS REFERENCES TO RELATED APPLICATIONS

U.S. Pat. No. 5,808,218, issued Sep. 15, 1998, entitled "Expressive Musical Instrument With Which Accurate Pitch Can Be Played Easily," of inventor Charles H. Grace, is incorporated in and made part of the instant patent application by reference.

U.S. Pat. No. 4,429,609, issued Feb. 7, 1984, entitled "Pitch Analyzer," of inventor David J. Warrender is incorporated in and made part of the instant patent application by reference.

U.S. Pat. No. 5,668,340, issued Sep. 16, 1997, entitled "Wind Instrument with Electronic Tubing Length Control," of inventors Hikaru Hashizume and Yutaka Washiyama is incorporated in and made part of the instant patent application by reference.

STATEMENT REGARDING FEDERALLY SPONSORED RESEARCH OR DEVELOPMENT

Not Applicable.

THE NAMES OF THE PARTIES TO A JOINT RESEARCH AGREEMENT

Not Applicable.

INCORPORATION BY REFERENCE OF MATERIAL SUBMITTED ON A COMPACT DISC

Not Applicable.

BACKGROUND OF THE INVENTION (1) Field of the Invention

The invention relates to electronic fine tuning of the frequency of musical instruments in which there is a standing acoustic wave.

(2) Description of Related Art Including Information Disclosed Under 37 CFR 1.97 and 1.98

Acoustic standing waves in a musical instrument have both pressure vibrations and longitudinal air-velocity vibrations and are mostly confined within boundary walls of a resonant cavity. At certain points in the cavity, standing waves have velocity nodes of zero fluid velocity and maximum pressure. Between those velocity nodes are pressure nodes, which are points of zero pressure and maximum fluid velocity.

In the head joint of a conventional flute, an air-velocity node is always located at the face of the tuning plug, that is, the longitudinal air velocity is zero at the face of the tuning plug. Overall tuning is accomplished in a conventional flute by sliding the entire head joint relative to the body or by repositioning the tuning plug within the head joint, to change the length of the cavity. In a conventional instrument neither of those tuning procedures can be done note-by-note while playing music.

Many flutes are inaccurately intoned because some of the holes are used in differing combinations for producing more than one note, which requires design compromises in the positions and sizes of the holes. Overall tuning does not correct such compromises because the inaccuracies of intonation reside in the relative pitches of notes within the scale. Numerous design tricks attempt to alleviate the problem.

U.S. Pat. No. 5,808,218 discloses a wind instrument in which the resonant cavity is changed by physically moving the tuning plug with a servomechanism.

U.S. Pat. No. 4,429,609 discloses identification of a played musical note by means of a computer.

U.S. Pat. No. 5,668,340 discloses changing of the pitch of a wind instrument by electronically changing the length of a resonant cavity by injecting an audio tone into the resonant cavity.

BRIEF SUMMARY OF THE INVENTION

The invention tunes the frequencies of standing acoustic waves in a resonant cavity by a control system having no moving parts. The system tunes correctly even when the musician changes the notes rapidly.

Using a flute as a exemplary embodiment, with this invention the pitch is controlled by replacing a tuning plug, at one end of the flute cavity, with a tuning actuator such as an electromagnetic speaker. The tuning actuator is energized with an audio signal that is designed to correct the pitch of the played note by pulling it. The energizing signal is in quadrature phase relationship to the main tone in the flute. Ir stays in quadrature as the pitch is corrected, so it does not cause undesired whistling tones.

Quadrature vibrations of the tuning actuator change the phase of the standing wave, so as to create a "virtual wall" spaced slightly behind or ahead of the tuning actuator itself. That has the effect of changing the effective length of the resonant cavity in the flute and hence the frequency.

The maximum amount of fine-tuning required in a flute is relatively small because the frequency ratio of two contiguous half-tones is only six percent of their center frequency and the tuning error is less than half of a half-tone.

The pitch is corrected whether the errors are caused by inherent defects of the flute, by inadvertent off-pitch playing by the musician, or both. There is a "bending" provision described below for intentionally playing off-pitch for artistic expression. U.S. Pat. No. 5,668,340 demonstrates that injection of additional vibrations into a resonant cavity can affect the pitch, but that uses a different approach requiring much more apparatus.

BRIEF DESCRIPTION OF THE SEVERAL VIEWS OF THE DRAWING(S)

DETAILED DESCRIPTION OF THE INVENTION

Functions

In a flute embodiment of the present invention the tuning plug is replaced by a tuning actuator that is electronically energized, and whose vibrations change the effective cavity length. The tuning actuator's vibrations are substantially at quadrature (right angle) to the phase of the primary tone. That changes the pitch, not by introducing a second tone, but by changing the length of the cavity to amend the primary tone.

Using an internal pitch reference and a closed feedback loop, the instrument automatically brings a played note onto correct pitch. The volume and other aspects of the tone are controlled by the player, and the player can also deviate from the pitch for artistic effect with a "bending" lever, as explained later.

The instrument improves a player's "ear" because the player can always hear the correct pitch. Even expert musicians benefit from the invention because they need not subconsciously compensate for off-pitch intonation caused by the design limitations of the flute.

The instrument automatically energizes a tuning actuator 26 with a corrective quadrature audio-frequency signal, in the following way.

An electronic sensor 31 picks up a specimen of the flute tone to serve as a feedback signal in a feedback loop. The instrument measures the difference between (a) the frequency of the flute tone currently being played and (b) an internal reference pitch The difference is a frequency-error signal. Based in part on the frequency-error signal, the feedback signal drives the tuning actuator 26. The feedback signal is substantially 90° away from the phase of the main signal.

The tuning actuator 26 produces a corrective acoustic vibration that brings the tone onto pitch by changing the effective length of the flute.

The error signal of the played tone is averaged over a short time to permit vibrato as in a conventional flute. That simple feature is not detailed herein.

Phasors can be used to describe the waves because the injected correction signal always tracks the frequency of the main resonant frequency, except for a minuscule error signal.

Equipment

Figure 1:
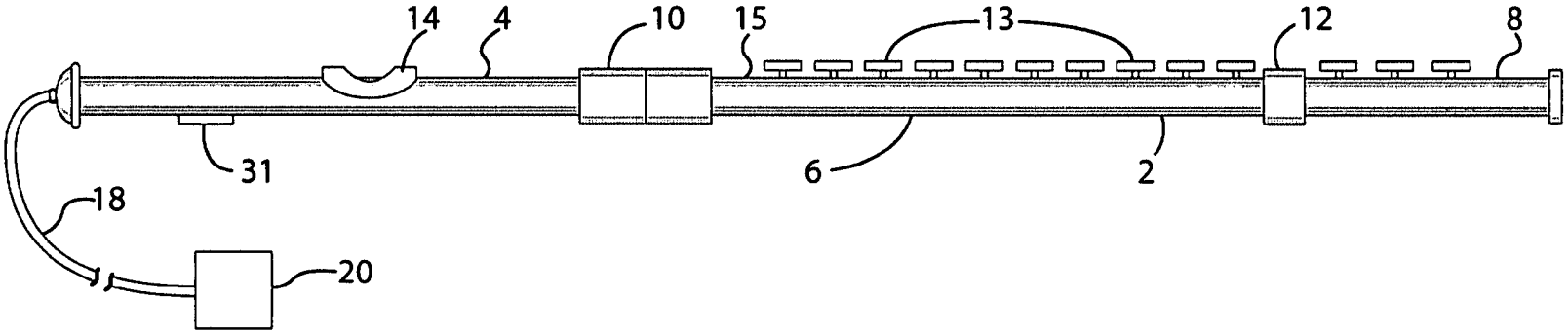
FIG. 1 shows a flute as one embodiment of the invention.

1. FIG. 1 shows the major sections of the flute 2. They are a head joint 4, a body 6, and a foot 8. An embouchure-hole pad 14 is affixed in the head joint 4 to serve as a primary source of tone in the flute. The body and foot sections have conventional finger keys 13 and an unusual pitch-bending lever 15. A packet of external electronic circuits 20 is also shown, connected to the flute by a cable 18.

Figure 2:
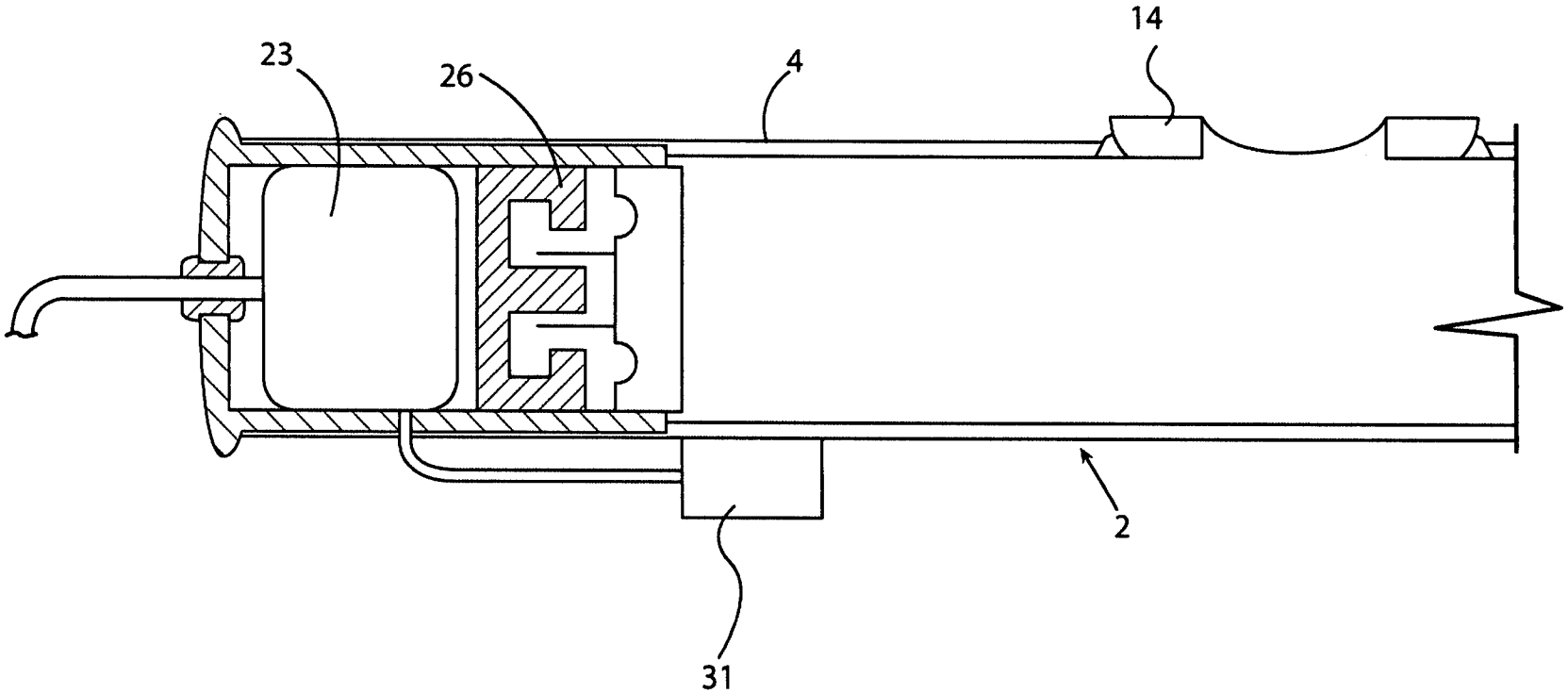
FIG. 2 is a cross-sectional view of a head joint of the flute.

2. FIG. 2 includes an electronic sensor 31, whose inside surface is affixed smoothly on the inside surface of the flute an inch away from the embouchure hole toward the tuning plug. A package of electronic circuits 23 inside the head joint is also shown.

Figure 3:
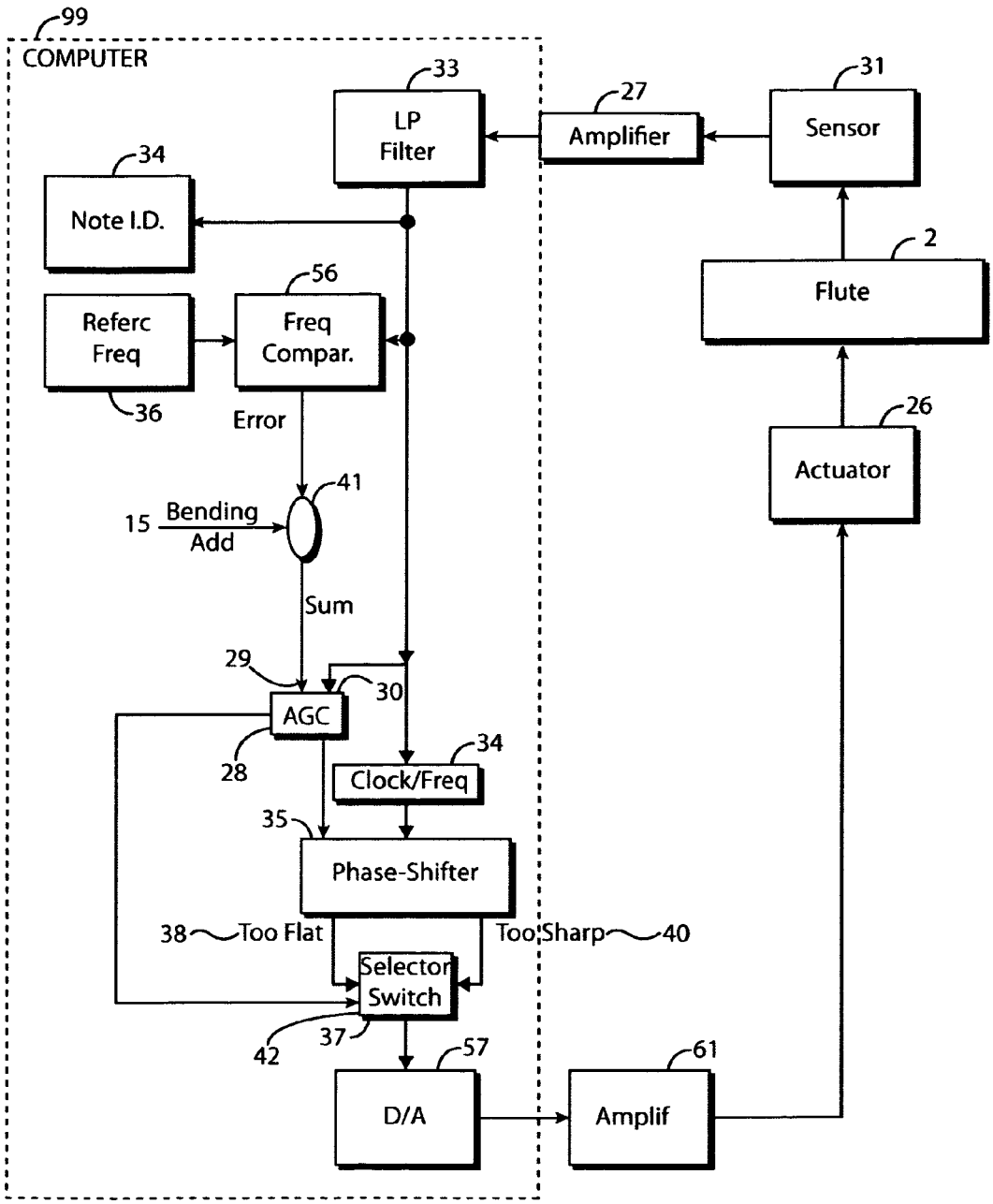
FIG. 3 is an electronic block diagram of the invention.

3, FIG. 3 shows the electronic sensor 31, connected to a preamplifier 27.

4. Preamplifier 27 has a gain of 10 db. Its output is input to a digital computer 99, within which it goes to a low-pass filter 33.

5. The he low-pass filter 33 prepares the signal for the digital computer. The output of the low-pass filter 33 goes several places including to the signal input terminal of a frequency comparator 56 and a note-identification circuit 34, which are parts of the computer.

6. The note-identification circuit 34 selects the on-pitch note that is closest to the fundamental frequency of the note played. Circuit 34 has contiguous ranges of frequencies whose widths are 6% of the center frequency of each range as in an equal-temperament scale. Each range has a unique identifying number corresponding to a note. The identifying number from circuit 34 is input to a frequency reference generator 36.

7. The frequency reference generator 36 can generate all of the scale notes in the range of a flute. As in the prior art, the generator 36 comprises a crystal-controlled clock oscillator feeding a frequency divider. The divisor of the frequency divider is stored in a memory portion of generator 36 and is addressed by the note-identification circuit 34. The output of the frequency reference generator 36 is a note of correct pitch, which is sent to the frequency comparator 56.

8. Frequency comparator 56 is also conventional, and is also a portion of the computer 99. It compares the frequency from the frequency reference generator 36 with the fundamental frequency of the played note. Frequency comparator 56 sends out an error signal that is a measure of the frequency difference, to an adder 41.

9. A manual lever 15, shown in FIG. 1, is located near the finger keys of the flute and enables the musician to "bend" the pitch of a note sharp or flat. The lever 15 is a center-off spring-return type. It causes the note to go sharp or flat depending upon the direction the lever is deflected from center, in an amount proportional to the distance. Its output signal goes to the adder 41.

10. The adder 41 adds the bending signal from lever 15 to the error signal from comparator 56. The output of adder 41 goes to a gain-control amplifier 28.

11 Pitch correction is accomplished by controlling the amplitude of the output of the gain-control amplifier 28. Amplifier 28 sets the gain of the feedback channel.

The amplifier 28 receives its tone input signal from the low-pass filter 33 at its tone input terminal 30. In addition to a tone input signal terminal 30, the amplifier 28 has a gain-control terminal 29. In analog circuits this would be called automatic gain control (AGC) amplifier, in which the gain is controlled by a DC signal applied to a gain-control terminal. In this embodiment the AGC function is performed by the digital computer 99.

12. One output of gain-control amplifier 28 is connected to a phase shifter 35, which shifts the signal into substantially quadrature phase relationship with the principal tone in the flute. Optionally, the quadrature signal may actually be biased to be a few degrees greater than 90° to enhance stability of the loop.

A second output of amplifier 28 goes to a selector switch 37, further described below, which selects a different phase delay if the principal tone is sharp than if the principal tone is flat.

Phase shifter 35 has two outputs. A delay of nominally 270° comes out at a terminal 40 and a tap at nominally 90° exits at a terminal 38. The word nominally is employed because an optional bias of a few degrees increases the delay to a few degrees greater than 90°. The exact amount of bias depends upon phase shifts that occur depending upon design details of the feedback loop.

The nominal 270° delay is equivalent to a nominal 90° lead, so it provides a nominal 90° advancement of phase to the next-following cycle.

If the note is too flat the signal is delayed nominally 270° and if the note is too sharp the delay is nominally 90°. An nominally 270° phasor makes the pitch higher.

A delay of 90 degrees is different in seconds for different frequencies, of course, so a circuit 39 is provided to make the clock rate of the delay line proportional to the frequency of the tone being played. The delay line therefore accomplishes a given delay, say 90o, irrespective of the frequency.

13. The two outputs of phase shifter 35 go to a digital selector switch 37 that selects the correct phase shift depending upon whether the note is too flat or too sharp.

14. The output of switch 37 goes to a digital-to-analog converter (D/A) 57.

15. An amplifier 61 receives the output of the D/A 57 and amplifies it with fixed gain. The output of amplifier 61 is always a tone of the same frequency as the tone in the flute except for an insignificant error signal. It is in quadrature phase relationship to the main tone in the flute. The, output of amplifier 61 is connected to the tuning actuator 26.

16. The tuning actuator 26 is in effect a plug stop whose location is electrically controllable. Its "virtual" position (effective location) is controlled by the power with which it is energized. The reason the tuning actuator 26 controls the pitch is that the signal driving the tuning actuator 26 has a substantially quadrature relationship relative to the phase of the main tone.

The amplitude of the signal that drives the tuning actuator 26. is proportional to the loudness of the original in-flute tone (as well as to the amount of frequency error). In the preferred embodiment that amplitude is automatically proportional to the loudness because the signal at the amplifier 28 originates from the acoustic sensor 31.

The tuning actuator 26 produces a quadrature acoustic wave to change the effective length of the flute's resonant cavity slightly. It changes the phase of the audio tone by adding a quadrature phosor to the principal tone.\. Audio vibration of the tuning actuator 26 brings the standing wave in the flute onto the desired pitch. There is only one fundamental frequency in the flute at any time, but of course there are harmonics Operation The following is a list of the events carried out by the feedback program in playing an on-pitch note. Most of the events involve the computer 99. The numbered events below have the same computer step numbers as FIG. 4.

The flute is first tuned overall in a conventional manner by blowing a note such as a 440 Hz note and sliding the entire head joint to bring the pitch to 440 Hz. There is a Zero Switch for overall tuning; after overall tuning it should be placed in the Play position.

Blow the flute to play a note. The acoustic sensor 31 produces an electronic signal.

Preamplifier 27 in the computer receives the signal from sensor 31 and amplifies it with fixed gain.

1. The low-pass filter 33 in the computer smoothes the amplifier signal and conditions it for computer use.

2. One output from the low-pass filter 33 goes to the note-identification circuit 34. There, the intended note is identified by comparing it with an array of frequency ranges to find the frequency range into which the played frequency fits. The ID circuit 34 sends out a note-identifying number.

3. The note-identifying number addresses the frequency reference generator 36, which responds with an on-pitch reference frequency corresponding to the intended fundamental note. For example, if an A4 note is played, generator 36 produces a 440 Hz note.

The on-pitch reference frequency is sent from the reference generator 36 to the frequency comparator 56.

4. Frequency comparator 56 compares the fundamental frequency of the tone in the flute with the reference frequency received from the frequency reference generator 36 and produces a DC error signal indicative of the difference in frequency. The error signal is positive if the note is sharp or negative if the note is flat. The error signal is conducted from comparator 56 to an adder 41.

5. If there is a "bending" signal from the player for deflecting the pitch for artistic expression, a bending signal component is added to the error signal in the adder 41. The bending signal can call for sharp or flat deflection.

6. The output of the adder 41 goes to the gain-control amplifier 28. The gain-control amplifier 28 sets the gain of the feedback signal to whatever amount is required to correct the pitch. In addition to the error signal and the bending signals, at terminal 29, the volume of the tone presently in the flute also controls to the amplitude of the feedback signal, via terminal 30.

The audio input signal at terminal 30 has a frequency the same as the sound in the flute and has amplitude that is approximately proportional to the amplitude of the sound in the flute.

The sign of the error from adder 41 indicates whether the played note is to be made sharper or flatter. In the case of a note that is too sharp, the feedback moves the "virtual position" of the tuning actuator 26 to make the resonant cavity longer. The cavity is made shorter if the note is too flat.

7. The phase shifter 35 is a delay line that shifts the phase of the signal it receives from AGC amplifier 28. The outputs of the delay line are in quadrature with the main tone in the flute.

8. The desired phase shift is measured in degrees, not a certain number of seconds. The clock frequency of the phase shifter 35 is therefore controlled by the frequency of the audio signal in the flute. The clock rate is set by a clock frequency circuit 39. Circuit 39 simply applies a fixed multiple of the flute frequency to the clock terminal of the phase shifter 38. That makes the shifter's clock rate proportional to the frequency of the played tone.

Tpnes coming out of the phase shifter 35 at a terminal 40 are delayed 90° and tones coming out at a terminal 38 are delayed 270°. The 270° delay creates a 90° advance of the next-occurring cycle.

9. A signal from the AGC circuit 28, at a terminal 42 of the switch 37 tells whether the note is too flat or too sharp. The digital switch 37 selects terminal 40 to provide a 90° delay to correct notes that are too sharp, and selects terminal 38 to provide the 270° delay for notes that are too flat.

10. The output of the digital switch 37 drives the digital-to-analog converter (D/A) 57.

The D/A converter 57 drives the fixed gain amplifier 61.

The amplifier 61 drives the tuning actuator 26. Because of its quadrature phase, the signal sent to the tuning actuator 26 controls the effective length of the flute cavity and hence the pitch. It the preferred embodiment of a flute the change of pitch is very slight.

When the pitch becomes correct, the frequency comparator 56 indicates an error very nearly zero.

The foregoing steps are repeated when the player plays the next note.

Figure 4:
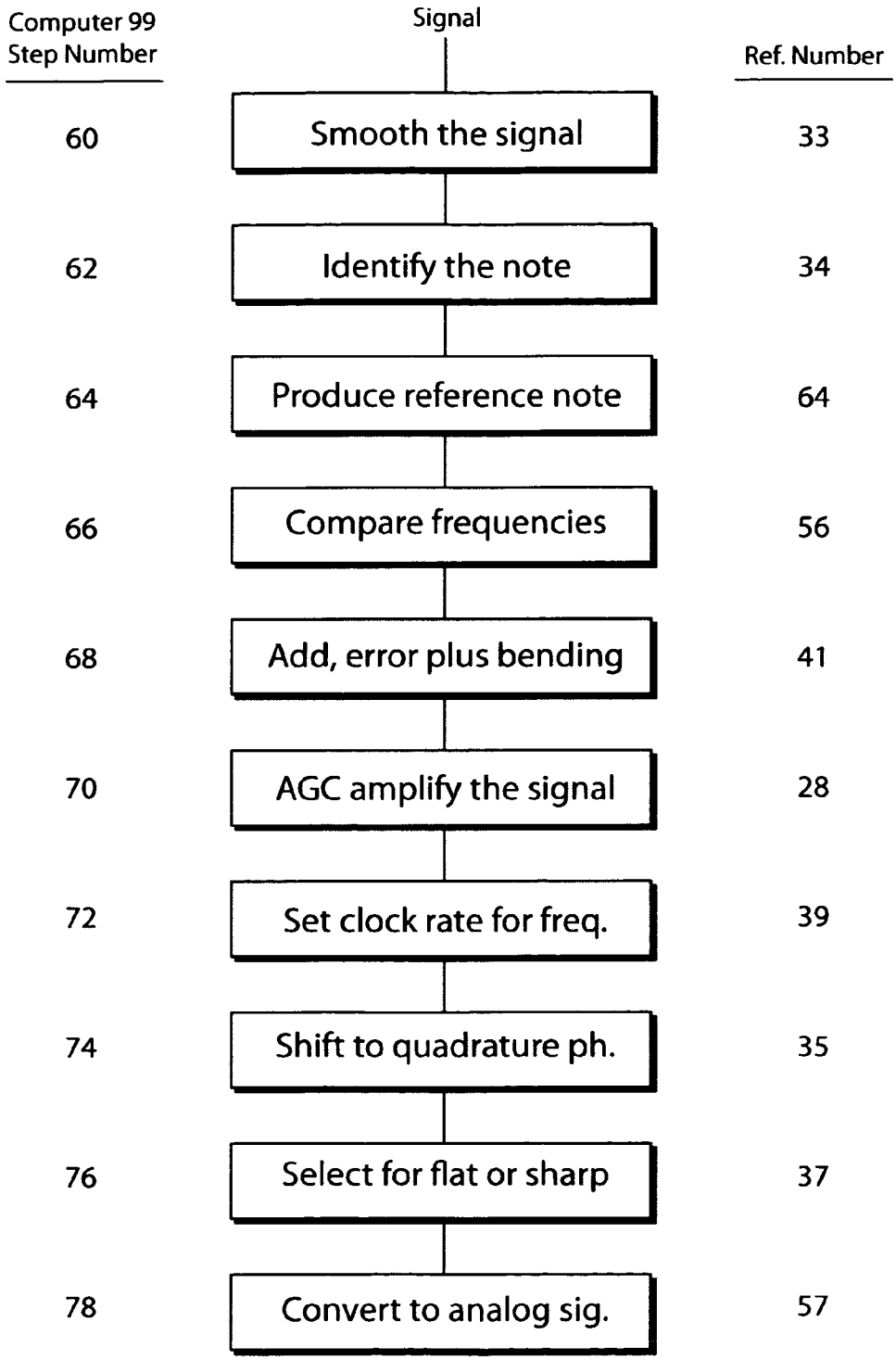
FIG. 4 is a flow chart of a computer program for the invention.

FIG. 4 outlines briefly the program of the computer 99. All of the computer steps are conventional in the prior art.

When a musician blows a note, acoustic sensor 31 picks up the note and preamplifier 27 amplifies it. Steps are:

1. Filter 33 in the computer smoothes the signal and makes it suitable for use by the computer. Computer step No. 60.

2. Note ID circuit 34 identifies the note. Computer step No. 62.

3. Reference frequency generator 36 produces an on-pitch note. Computer step No. 64.

4. Frequency comparator 56 compares the played tone with the reference frequency and produces the error signal Computer step No. 66.

5. Adder 41 adds the error signal and the bending signal if any. Computer step No. 68.

6. AGC circuit 28 receives the signal from filter 33 at a terminal 30 and amplifies it by an amount dictated by a signal received at a terminal 29 from the adder 41. Computer step No. 70.

7. The clock frequency of phase shifter 35 is controlled by the auxiliary clock oscillator 34. Clock frequency circuit 34 multiplies a signal from the filter 33 to set the clock rate at which the phase shifter 35 will operate. Computer step No. 72.

8. Phase shifter 35 shifts the phase of the tone of the AGC output signal. Phase shifter 35 actually produces two phase shifter signals, one for a "too sharp" note at a terminal 40 and one for a "too flat" note at a terminal 42. Both have close to a quadrature phase shift but they may have slightly different phase bias if optional bias is employed. Computer step No. 74.

9. A sign-error signal comes from the AGC circuit 28 to terminal 42 the selector switch 37. Selector switch 37 selects a phase shift depending upon whether the sign of the error shows at that the tone is too sharp or too flat. Computer step No. 76.

10. D/A 57 converts the signal and sends it out of computer 99. Step No. 78. The signal is substantially 90° displaced from the primary tone in the flute. That's the end of the program of computer 99.

Amplifier 61 drives the actuator 26 with a quadrature signal.

External Circuits

In the embodiment described above, external sub-circuits 20 are in a separate packet for placement in the player's clothing or elsewhere and connected to the flute by a thin electrical cable 18.

The external sub-circuits 20 include a conventional line-operated power supply that provides low-voltage power required by various sub-circuits. DC power devices known as converters or line adaptors are available in retail stores, but one that is purpose-built for the required voltages and current capacities is preferable here.

Other Embodiments

1. Player-Generated Vibrato

Player-generated vibrato is preserved by including a ¼-second averaging circuit in the feedback loop, which is not described or claimed herein.

2. Equipment-Generated Vibrato

A player may choose to turn on an optional electronic vibrato circuit that is built into the flute. Numerous conventional vibrato circuits are suitable.

3 Harmonics

Harmonics above the fundamental tone can be processed in the same way as the fundamental tone and added as harmonics to the correction signal. However, harmonic correction has not been described herein, as it is ordinarily corrected automatically upon correcting the fundamental.

4. Alternative Tone Pickup

The location and type of the tone pickup 26 affect the phase delay of feedback, and the phase adjustment is readily tailored to the pickup's type and location during detailed design.

5 Alternative Reference-Frequency Generator

Although the instrument preferably employs a conventional reference-frequency generator comprising a clock oscillator and scalar, a non-volatile addressable storage memory in which a plurality of reference frequencies are stored in advance, could be employed instead.

6. Alternative Note-Identification Circuits

Although the preferred embodiment identifies the intended note by electronically comparing the frequency being played with an array of frequency ranges, various other conventional means of identifying the closest intended-note could be used instead.

For example, in one alternative embodiment, key-actuated switches detect the positions of the finger keys 13. This alternative method for identifying a selected note is commonly used in the prior art by Yamaha and Casio companies.

Yet another alternative means for sensing the positions of keys is to use conventional capacitive proximity sensors.

7. Alternative Tuning Actuator

Instead of being an electromagnetic loudspeaker as in the preferred embodiment, the tuning actuator 26 can be stacked piezoelectric crystals or other acoustic transducers.

8. All Equipment Mounted on the Flute

If desired, all of the equipment can be sufficiently miniaturized to be located in the flute itself—including the batteries.

9. Instruments Other than Flutes

The invention also applies to reed instruments, brass instruments, acoustic organs and other musical instruments that involve standing waves whose pitch can be tuned by a mechanical element of the resonant cavity. The mechanical element can be partially or wholly replaced by an electronic tuning actuator of the present invention.

10. Alternative Designs

Wherever digital circuits are employed in the preferred embodiment, analog circuits could be used instead, and wherever analog circuits are employed, digital circuits could be used instead.

11. Independent Oscillator.

An audio oscillator could be used for providing a corrective signal to the tuning actuator 26. The oscillator's frequency would be synchronized with the signal from the sensor, and be tuned to an approximately quadrature phase relative to the sensor's signal. The oscillator's amplitude would track the error signal.

12. Over-all Electronic Tuning.

Electronic overall tuning of the instrument to different reference pitches such as A4 of 435 Hz can be readily accomplished with this invention.

What is claimed is:

1. A musical instrument having apparatus for tuning the frequency of a tone comprising:

an acoustic cavity for enclosing a standing wave having a resonant frequency;

a tuning actuator for vibrating when energized by an electrical signal, said tuning actuator forming a portion of a boundary of said cavity at a location that affects said resonant frequency;

an electrical sensor for sensing said standing wave and producing a sensor signal;

means for providing a frequency-error signal indicating an error in said resonant frequency;

means responsive to said sensor signal and said frequency-error signal, for producing a tuning signal in quadrature phase relationship with said standing wave;

said tuning signal communicating with said tuning actuator to create an acoustic vibration within said cavity that is in substantially quadrature phase relationship with said standing wave;

whereby the frequency of said standing wave is changed.

2. Apparatus as in claim 1 and wherein the amplitude of said tuning signal is responsive to the amplitude of said sensor signal and the value of said frequency-error signal.

3. Apparatus as in claim 1 and wherein said means for producing said frequency-error signal comprises:

means for providing a frequency-reference signal indicating an accurate frequency for said tone;

a comparator for measuring the difference in frequency of said frequency-reference signal and the frequency of said sensor signal to provide said frequency-error signal.

4. Apparatus as in claim 3 and wherein said means for providing a frequency-reference signal comprises a memory for storing a reference frequency.

5. Apparatus as in claim 3 and wherein said means for providing a frequency-reference signal comprises a computer for generating a reference frequency.

6. Apparatus as in claim 1 and wherein said tuning actuator comprises an electromagnetic speaker.

7. Apparatus as in claim 1 and wherein said tuning actuator comprises a piezoelectric transducer.

8. Apparatus as in claim 1 and wherein said musical instrument is a flute and said tuning actuator comprises an electrical plug-stop at a closed end of said cavity.

9. A method for tuning a musical wind instrument having a resonant cavity comprising:

producing a standing wave from a primary source to resonate at a first frequency in said cavity;

sensing said standing wave and providing an electrical sensor signal of said first frequency;

providing a reference frequency signal defining a desired frequency;

producing an error signal indicating how much to change said first frequency;

producing a quadrature tuning signal in response to said sensor signal and said error signal, in substantially quadrature phase relationship with said electrical sensor signal;

disposing a tuning actuator to form a portion of a wall of said cavity where said portion of a wall affects said resonant frequency;

energizing said tuning actuator with said quadrature tuning signal to vibrate in said cavity together with said standing wave, whereby said first frequency is changed.

10. A method as in claim 9 and wherein producing a quadrature tuning signal comprises controlling the amplitude of said quadrature tuning signal in response to the amplitude of said electrical sensor signal.

11. Method as in claim 9 and wherein providing said error signal comprises providing a comparator and comparing said reference frequency with said electrical sensor signal.

12. Method as in claim 9 and wherein said step of providing a reference frequency comprises referring to a memory means having reference frequencies.

13. Method as in claim 9 and wherein said step of providing a reference frequency comprises generating a reference frequency with a computer.

14. Method as in claim 9 and wherein said step of disposing a tuning actuator comprises disposing a tuning actuator so as to form a wall boundary less than 40° of said standing wave away from said substantially closed end.

* * * * *